United States Patent [19]

Ittipiboon et al.

[11] Patent Number: 4,516,129

[45] Date of Patent: May 7, 1985

[54] WAVEGUIDE WITH DIELECTRIC COATED FLANGE ANTENNA FEED

[75] Inventors: Apisak Ittipiboon; Lotfollah Shafai; Ernest Bridges, all of Winnipeg, Canada

[73] Assignee: Canadian Patents & Dev. Ltd., Ottawa, Canada

[21] Appl. No.: 385,251

[22] Filed: Jun. 4, 1982

[51] Int. Cl.[3] ..... H01Q 13/00

[52] U.S. Cl. ..... 343/772; 343/785

[58] Field of Search ..... 343/772, 771, 773, 762, 343/785, 840

[56] References Cited

U.S. PATENT DOCUMENTS

| | | | |
|---|---|---|---|
| 2,414,376 | 1/1947 | Heim | 343/772 |
| 2,556,046 | 6/1951 | Simpson | 343/773 |
| 2,617,029 | 11/1952 | Plummer et al. | 343/762 |
| 2,742,640 | 4/1956 | Cronin | 343/772 |
| 2,761,138 | 8/1956 | Sherman | 343/762 |
| 2,921,309 | 1/1960 | Elliott | 343/773 |
| 2,993,205 | 7/1961 | Cooper | 343/771 |
| 3,434,146 | 3/1969 | Petrich | 343/772 |
| 3,553,707 | 1/1971 | Yang et al. | 343/781 |

FOREIGN PATENT DOCUMENTS

| | | | |
|---|---|---|---|
| 1403298 | 8/1975 | United Kingdom | 343/771 |

*Primary Examiner*—Eli Lieberman
*Assistant Examiner*—K. Ohralik
*Attorney, Agent, or Firm*—Edward Rymek

[57] ABSTRACT

The antenna feed includes a waveguide radiator with a conductive flange positioned about the waveguide near its radiating end. A dielectric element is positioned about the waveguide between the flange and the radiating end and establishes the dielectric surface impedance seen by the waveguide. The dielectric element may consist of one or more layers of dielectric material to form a composite dielectric. One of the layers may be an air gap adjacent to the flange. The size and position of the flange and dielectric element will control the radiation pattern of the beam from the feed.

2 Claims, 3 Drawing Figures

WAVEGUIDE WITH DIELECTRIC COATED FLANGE ANTENNA FEED

BACKGROUND OF THE INVENTION

This invention is directed to paraboloid antennas, and in particular to a simple feed for these antennas.

The prime focus fed paraboloid is one of the most commonly used high gain antenna systems. It has been widely used in earth-station antennas, microwave relay systems and radio-telescopes. It has a simple geometry and is generally inexpensive to fabricate. It consists of a reflecting paraboloid surface with a feed system at its focus. Since the performance of this type of antenna relates closely to its feed, the feed has to be designed for high antenna efficiency and low cross-polarization, which can be achieved with a feed having a symmetric E and H plane radiation patterns. A common feed, which has been used because of its simplicity and low cost, is a waveguide radiator supporting the dominant mode. However, this type of feed generally has asymmetric E and H plane radiation patterns, thus causing a loss in the efficiency of the reflector and a high cross-polar radiation. High efficiency feeds with symmetric E and H plane patterns are normally designed using corrugated or multi-mode horns. A common design consists of a circular waveguide with a 90 degree corrugated flange, such as the one described in Canadian Pat. No. 873,547, which was issued to R. F. H. Yang et al on June 15, 1971, and which corresponds to U.S. Pat. No. 3,553,707, which issued on Jan. 5, 1971. It can be designed to have good circular patterns, to give high efficiency with reflector antennas, but due to its corrugated surface, is costly to fabricate.

SUMMARY OF THE INVENTION

It is therefore an object of this invention to provide a feed which is capable of producing symmetric E and H plane patterns and which still is relatively simple to fabricate.

This and other objects are achieved in the feed for a paraboloid antenna which includes a waveguide with a first end having an electrical coupler, and a second radiating end. A conductive flange is positioned about the waveguide at a predetermined distance from the radiating end. A dielectric element is positioned about the waveguide between the flange and the radiating end, this element establishes the surface impedance seen by the waveguide.

In accordance with one aspect of this invention, the dielectric element may consist of two or more layers of dielectric material. One of the dielectric layers may be an air gap adjacent to the flange.

In accordance with another aspect of this invention, the waveguide and flange may both be circular, the flange may have a diameter of less than 5λ and be positioned at a distance of less than λ from the radiating end of the waveguide, where λ is the wavelength of the operating frequency of the antenna.

Many other objects and aspects of the invention will be clear from the detailed description of the drawings.

DETAILED DESCRIPTION

Figure 1:
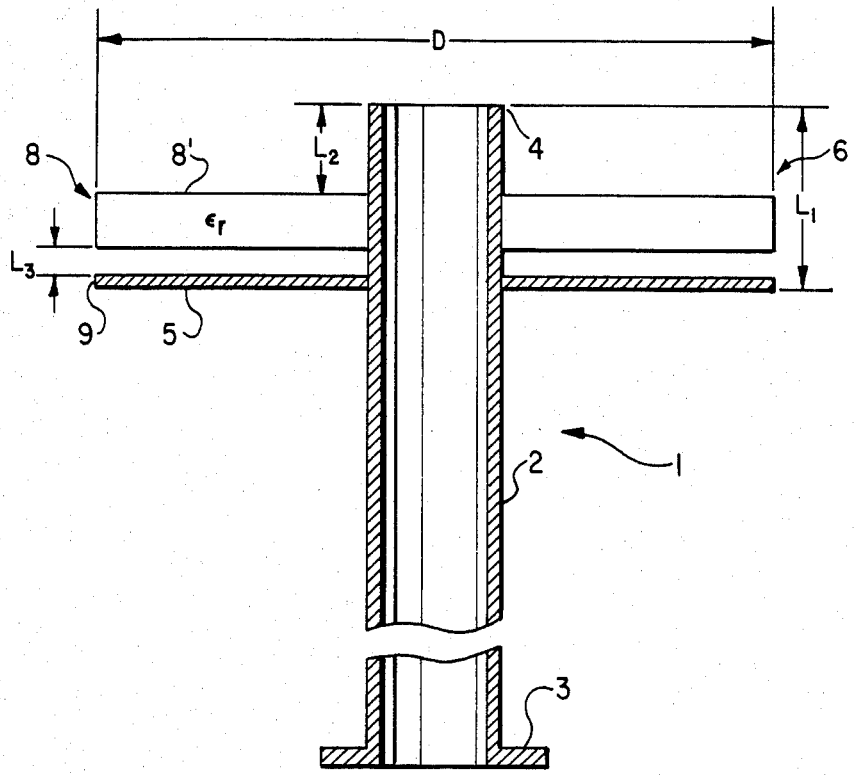
FIG. 1 illustrates, in cross-section, an antenna feed in accordance with the present invention.
Figure 2:
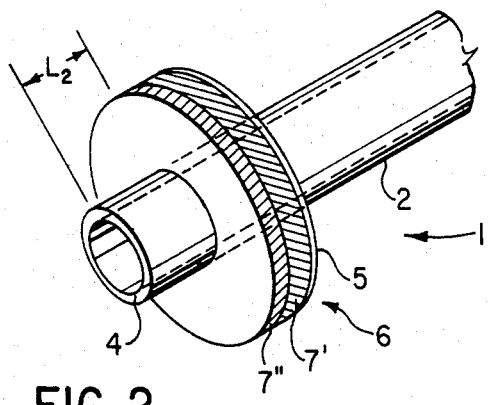
FIG. 2 illustrates a second embodiment of the antenna feed.

The antenna feed shown in FIG. 1 consists of a waveguide 2 which would normally be circular. One end of the waveguide 2 is fitted with a coupler 3, in any conventional manner, such that it may be electrically coupled to act as a transmitter or a receiver. For transmission, purposes the dominant $TE_{11}$ mode would normally be excited in the waveguide 2. The other end 4 of the waveguide may be open-ended or may include a transparent window which would be mounted in any conventional manner. In accordance with the present invention, the antenna feed 1 further includes a conductive flange 5 mounted about the waveguide 2 and electrically connected to it at a distance $L_1$ from the end 4 of the waveguide 2. For a circular waveguide 2, the flange may be circular with a diameter D. A dielectric element 6 is located about the waveguide 2 between the flange 5 and the radiating end 4 of the waveguide 2. The dielectric element 6 will preferably have at least the same dimensions as the flange 5 in the plane of the flange, i.e. with a diameter $\geqq D$ for a circular flange 5. The dielectric element 6 may consist of one or more uniform thickness, or tapered layers 7′, 7″ . . . , of dielectic material fixed to the flange 5 with the dielectric layer surface at a distance of $L_2$ from the end 4 of the waveguide 2 as shown in FIG. 2. However, in order to provide an adjustable feed 1, the dielectric element 6 may include one or more uniform thickness, or tapered layers 8′ . . . mounted about the waveguide 2 so as to be moveable along the waveguide 2 in the axis of the waveguide 2. In this type of element 6, the airgap 9 of thickness $L_3$ between the flange 5 and the layer 8′ will constitute one of the dielectric layers of the element 6 to form the composite dielectric.

The size and the position of the flange 5 are selected to control the backward radiation, the surface wave generation on the flange 5, as well as the desired radiation pattern. For normal operation, the diameter D of the flange 5 would be set at less than 5λ, where λ is the wavelength of the operating frequency. This flange size keeps surface waves at a low lever minimizing the side lobe level. The distance $L_1$ of the flange 5 from the end 4 of the waveguide 2 would normally not be greater than λ. This distance controls the relative phase of the reflected field and, thus, the radiation pattern of the feed 1.

The overall thickness and the composite dielectric constant $\epsilon$ of the dielectric element 6 determines the surface impedance seen by the waveguide from end 4. Though a suitable antenna feed 1 may be designed with a single dielectric layer 7′, the use of number of layers 7′, 7″ . . . , facilitates the optimum design of a feed 1 for a particular application since the various parameters may be more easily adjusted. In addition, the use of a moveable dielectric layer 8′ in the element 6 provides the flexibility of allowing the feed to be adjusted in its particular application.

As an example, a primary feed 1 for a reflector antenna which is to be excited by the dominant $TE_{11}$ mode in the frequency range of 11.0–12.0 GHz, consists of a circular waveguide 2 having a flange 5 of diameter $D=1.8\lambda$, positioned at a distance $L_1=\lambda$ from the radiating end 4 of the waveguide 2. A single dielectric layer 8′ of uniform thickness plexiglass, having a relative dielectric constant $\epsilon_r=2.54$, is positioned on the waveguide 2 at a distance $L_2=0.4\lambda$, from the end 4 such that the dielectric element 6 includes an airgap with a thickness $L_3=0.25\lambda$. These parameters of the flange 5 and the dielectric element 6 assure that the flange 5 can support only a $TM_0$ surface wave mode which combines with the dominant $TE_{11}$ mode to form the radiation pattern.

Figure 3:
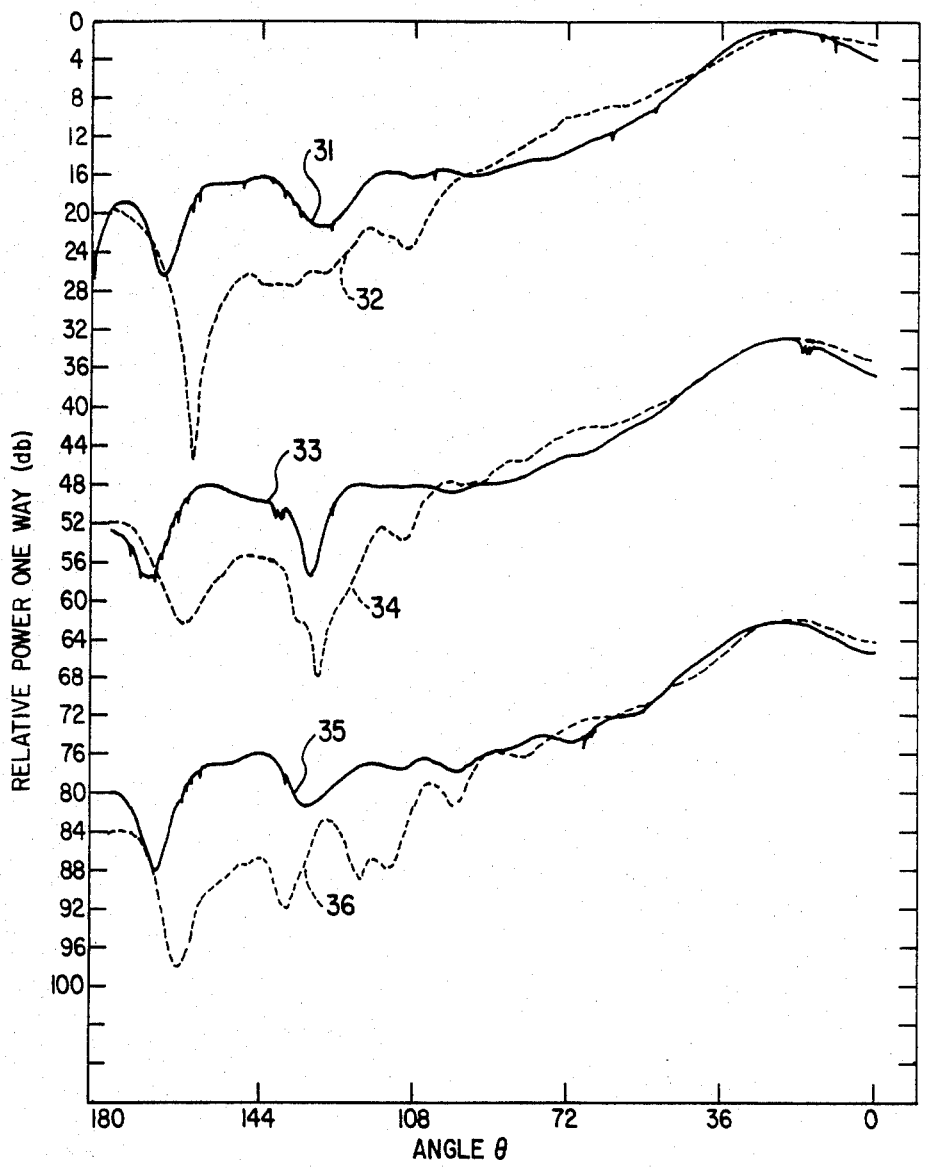
FIG. 3 illustrates the E-H radiation patterns of an antenna feed.

The E and H plane radiation patterns from this antenna feed are illustrated in FIG. 3, where lines 31, 33 and 35 represent the E-plane radiation pattern at 11.0, 11.5, and 12.0 GHz excitation, and, where lines 32, 34 and 36 represent the H-plane radiation pattern at 11.0, 11.5, and 12.0 GHz excitation, the planes for the different frequencies being normalized at different levels.

From these results, it is found that the E and H plane radiation patterns are quite similar for $\theta \geqq 96°$, which is a wide enough angle for most paraboloid reflectors. The patterns of both planes, E and H, have a dip along the antenna axis of about 3 dB and 2 dB, respectively, which can be controlled by the thickness of airgap 9 between the dielectric layer 8′ and the flange 5. Because of this dip in the radiation pattern, the aperture illumination of the reflector will be more uniform, thus providing a high gain factor. From the results shown in FIG. 3, it is also clear that the patterns are quite constant over the frequency range 11.0–12.0 GHz. It was found that the E-plane 10 dB half beamwidth at 11.0 and 11.5 GHz are approximately 68°, while it is about 66° at 12.0 GHz.

During cross-polarization measurements, it was found that the peak cross-polarization is approximately −20 dB at 11.0 GHz, −23 dB at 11.5 GHz, and −24 dB at 12.0 GHz. However, it should be noted that these are the cross-polarization levels of the feed, not the secondary pattern. The cross-polarization levels of the secondary pattern should be small when the E and H plane feed radiation patterns are similar.

The antenna feed in accordance with this invention is thus seen to have the advantages of having good transmission characteristics while at the same time being relatively easy and inexpensive to fabricate on either a small or large scale.

Many modifications in the above described embodiments of the invention can be carried out without departing from the scope thereof and, therefore, the scope of the present invention is intended to be limited only by the appended claims.

We claim:

1. A feed for a reflector paraboloid antenna comprising:

a circular waveguide with a first end having an electrical coupler and a second radiating end:

an annular conductive planar flange having an outside diameter $D \geqq 5\lambda$ positioned about the waveguide at a distance $L_1 \geqq \lambda$ from the radiating end where $\lambda$ is the wavelength of the operating frequency of the antenna; and an annular dielectric element consisting of two layers of dielectric material and having an outside diameter $\geqq D$ positioned adjacent the flange between the flange and the radiating end to establish a predetermined surface impedance seen by the waveguide.

2. A feed as claimed in claim 1 wherein one of the dielectric layers is an air gap adjacent the flange.

* * * * *